US006871752B2

(12) United States Patent
Montgomery

(10) Patent No.: US 6,871,752 B2
(45) Date of Patent: Mar. 29, 2005

(54) ROTARY SEAL FOR CLOUSURE WITH ON-STOP

(75) Inventor: Gary V. Montgomery, Evansville, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 0 days.

(21) Appl. No.: 10/066,908

(22) Filed: Feb. 4, 2002

(65) Prior Publication Data

US 2003/0146183 A1 Aug. 7, 2003

(51) Int. Cl.[7] ..... B65D 55/02
(52) U.S. Cl. ..... 215/219; 215/331
(58) Field of Search ..... 215/331, 330, 215/219, 344, 252, 216, 218, 343, 201, 221, 250–254, 200

(56) References Cited

U.S. PATENT DOCUMENTS

| | | | | |
|---|---|---|---|---|
| 1,499,612 A | | 7/1924 | Hammer | |
| 2,264,792 A | | 12/1941 | Gray et al. | |
| 3,770,153 A | * | 11/1973 | Gach et al. | 215/216 |
| 3,927,783 A | | 12/1975 | Bogert | |
| 4,053,077 A | * | 10/1977 | DeFelice | 215/217 |
| 4,084,716 A | * | 4/1978 | Bogert | 215/217 |
| 4,144,983 A | | 3/1979 | Pauls et al. | |
| 4,266,682 A | | 5/1981 | Speitel et al. | |
| 4,271,974 A | | 6/1981 | Quinard | |
| 4,310,101 A | | 1/1982 | Sekine | |
| 4,335,823 A | * | 6/1982 | Montgomery et al. | 215/206 |
| 4,519,518 A | | 5/1985 | Wiles et al. | |
| 4,540,098 A | * | 9/1985 | Luker | 215/216 |
| 4,609,115 A | | 9/1986 | Moore et al. | |
| 4,638,918 A | | 1/1987 | Marzabal Martinez | |
| 4,662,530 A | | 5/1987 | Goncalves et al. | |
| 4,993,570 A | | 2/1991 | Julian et al. | |
| 5,009,323 A | | 4/1991 | Montgomery et al. | |
| 5,040,692 A | | 8/1991 | Julian | |
| 5,145,080 A | | 9/1992 | Imbery, Jr. | |
| 5,160,057 A | | 11/1992 | Fitjer | |
| 5,184,741 A | | 2/1993 | Chevassus et al. | |
| 5,186,344 A | | 2/1993 | Cook | |
| 5,346,082 A | * | 9/1994 | Ochs et al. | 215/252 |
| 5,379,927 A | | 1/1995 | Montenieri et al. | |
| 5,445,466 A | | 8/1995 | Mukunoki | |
| 5,560,505 A | | 10/1996 | Schneider et al. | |
| 5,573,128 A | | 11/1996 | Tsujiguchi et al. | |
| 5,687,863 A | | 11/1997 | Kusz | |
| 5,740,932 A | | 4/1998 | Battegazzore | |
| 5,769,254 A | * | 6/1998 | King et al. | 215/330 |
| 5,927,527 A | * | 7/1999 | Montgomery et al. | 215/219 |
| 6,053,343 A | * | 4/2000 | Krueger | 215/209 |
| 6,105,801 A | | 8/2000 | Minnette | |
| 6,227,391 B1 | * | 5/2001 | King | 215/307 |
| 6,446,823 B2 | * | 9/2002 | Miceli et al. | 215/228 |

FOREIGN PATENT DOCUMENTS

| | | |
|---|---|---|
| EP | 0 007 274 A1 | 1/1980 |
| EP | 0 475 805 A1 | 3/1992 |
| FR | 2 413 284 | 7/1979 |
| GB | 2 044 736 A | 10/1980 |
| JP | 08217102 | 8/1996 |
| JP | 2000335611 | 12/2000 |
| JP | 2001097410 | 4/2001 |

* cited by examiner

*Primary Examiner*—Lien Ngo
(74) *Attorney, Agent, or Firm*—James E. Cole; John F. Salazar; Middleton Reutlinger

(57) ABSTRACT

A closure-container package comprising a container having a shoulder and a neck extending upward from the shoulder and having an external thread extending helically about the neck, a closure having a top wall and skirt depending from a peripheral edge of the skirt, the skirt having an internal thread mating with the external thread of the container neck, the closure having a rotary seal depending from the closure, the closure and container each having at least one on-direction stop mechanism operably engaged, the closure-container package having a child resistance feature and, the closure having a tamper indicating band with ratchets on an interior surface engaging ratchets on the container neck.

8 Claims, 4 Drawing Sheets

ROTARY SEAL FOR CLOUSURE WITH ON-STOP

BACKGROUND OF THE INVENTION

Technical Field of the Invention

The present invention relates generally to a threaded closure-container package. More particularly, the invention relates to a threaded closure-container package having a rotary seal, an on-direction stop mechanism, and a child resistance feature. Additionally, the closure-container package may have a tamper-indicating feature.

SUMMARY OF THE INVENTION

It is an object of the present invention to provide a threaded closure-container package.

It is a further objective of this invention to provide a threaded closure-container package having a rotary seal between the closure and the container.

It is still a further objective of this invention to provide a threaded closure-container package having a rotary seal between the closure and the container and an on-direction stop mechanism.

An even further object of the present invention is to provide a threaded closure-container package having a rotary seal between the closure and the container, an on-direction stop mechanism, and further comprising a child resistance feature.

An even further objective of the present invention is to provide a threaded closure-container package having a rotary seal between the closure and the container, an on-direction stop mechanism, a child resistance feature, and further comprising a tamper indicating band.

Specifically, a threaded closure-container package is provided which includes a container having a shoulder and a neck extending upward from the shoulder and having an external thread extending helically about the neck, a closure having a top wall and skirt depending from a peripheral edge of the skirt, the skirt having an internal thread mating the external thread of the container neck, the closure having a rotary seal depending from the top wall, the closure and container each having at least one on-direction stop mechanisms being operably engaged, the closure and container package having a child resistance feature, and, the closure having a tamper indicating band with ratchets on an interior surface engaging ratchets on the container neck.

All of the above outlined objectives are to be understood as exemplary only and many more objectives of the invention may be gleaned from the disclosure herein. Therefore, no limiting interpretation of the objectives noted is to be understood without further reading of the entire specification, claims, and drawings included herewith.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

Figure 1:
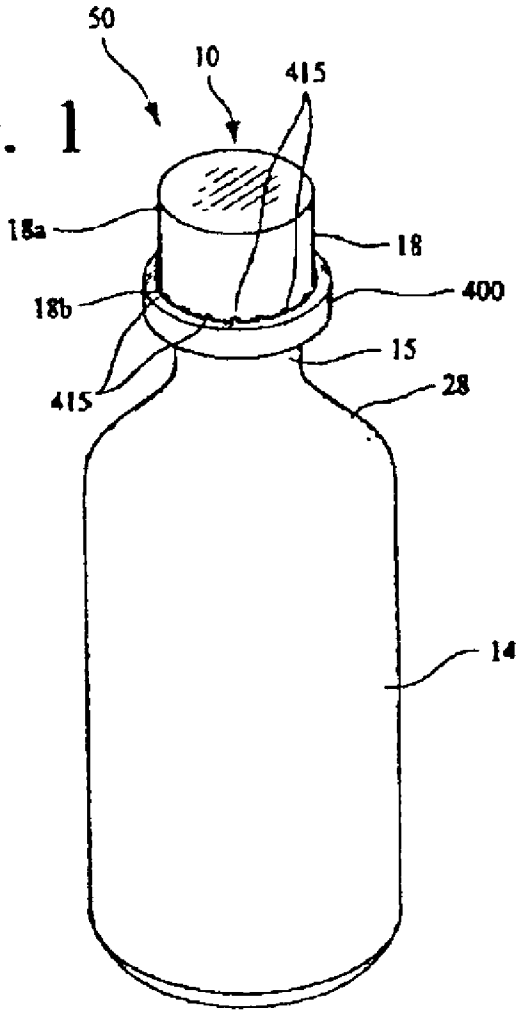
FIG. 1 shows a perspective view of the closure-container package of the present invention.
Figure 2:
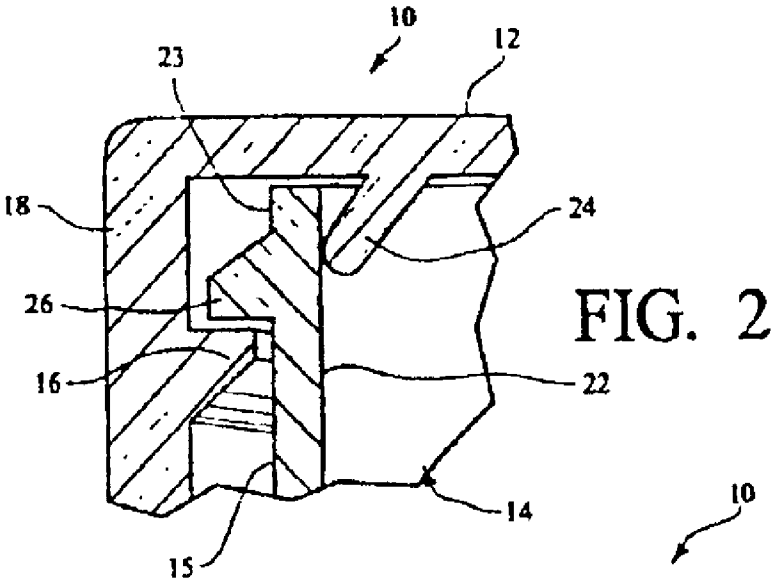
FIG. 2 shows a reverse taper plug rotary seal of the closure-container package of the present invention.
Figure 3:
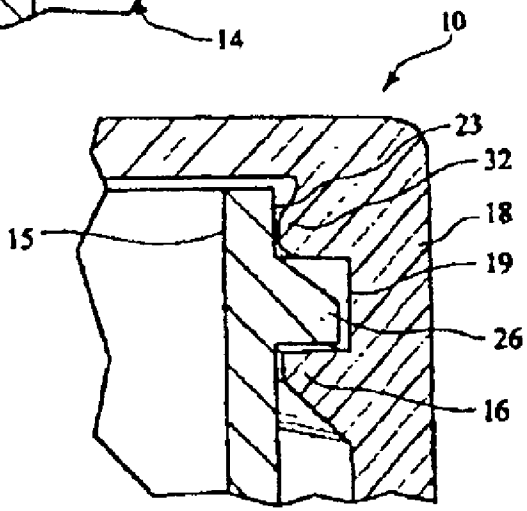
FIG. 3 shows an alternative embodiment of a rotary seal of the closure-container package of the instant invention.
Figure 8:
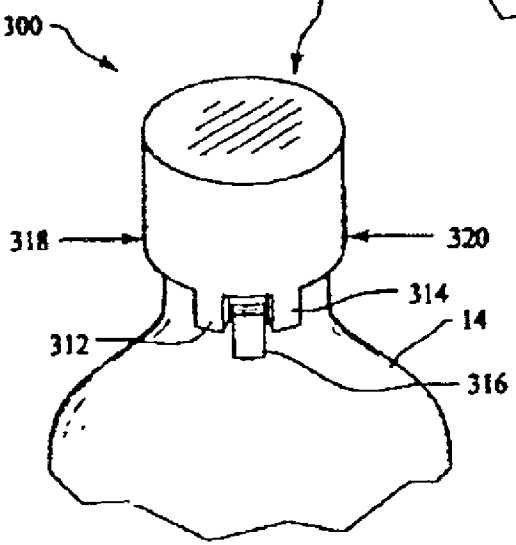
FIG. 8 shows a first child resistance feature of the closure-container package of the instant invention.

The present invention will now be described in conjunction with the drawings, referring initially to FIGS. 1 & 2, a threaded closure-container package 50 is shown. The threaded closure-container package 50 has a plurality of features which improve its functionality. The threaded closure-container package 50 generally comprises a closure 10 having a top wall 12 and a skirt 18 depending from a peripheral edge of the top wall 12. The skirt 18 has an upper portion 18*a* and a lower portion 18*b* as shown in FIG. 1. Extending from an inner surface of skirt 18 is an internal thread 16. The internal thread 16 mates with an external thread 26 of an upper portion or neck of container 14 as the closure 10 is preferably, screwed on to the container neck 15. As shown in FIGS. 2 & 3, the threaded closure-container package 50 preferably has a rotary seal 24 or 32 inhibiting leakage, spillage, and the like. The threaded closure-container package 50 also comprises an "on-direction" stop mechanism 200 generally shown in FIG. 4. The on-direction stop mechanism 200 inhibits overtorquing of threads 16,26 and resultant thread stripping. The on-direction stop mechanism 200 also inhibits overtightening of the closure 10 on a container neck 15 which may lead to seal damage and subsequent leakage. In addition, a child resistant feature 300 is also provided with the closure-container package 50 and is generally shown in FIG. 8. The child resistant package 300 inhibits one of tender years from obtaining the contents of container 14 and accidentally ingesting the drugs or chemicals retained therein. Finally, a tamper indicating band 400 may also be included in the closure-container package 50. The various embodiments of the closure-container package 50 will be described below.

Rotary Seal

Referring now to FIGS. 2 & 3 various embodiments of a rotary seal are shown, respectively. A reverse taper plug closure top seal 24 is shown in FIG. 2 further comprising a closure 10 and a container 14. The closure 10 has a top wall 12, preferably circular, but which may be of any desired shape. Depending from an outer peripheral edge of top wall 12 is a skirt 18. Extending inwardly from an inner surface of skirt 18 is an internal thread 16 which mates with external thread 26 of container 14.

Container 14 has a neck or upper portion 15 and an external thread 26 extending therefrom which rotatably engages the internal thread 16. As seen in FIG. 1, beneath the neck 15 is a shoulder 28 connecting the neck 15 to container 14 wherein medication, chemicals, liquid, or the like may be stored.

Referring again to FIGS. 1 & 2, depending downwardly and radially outward from the closure top wall 12 is the plug seal 24. The plug seal 24 depends circumferentially from the top wall 12 and generally is shaped like a hollowed upside-down frusto-conical plug or a reverse taper plug. Additionally, the reverse taper plug seal 24 is preferably formed from injection or compression molded plastic integral with the closure 10. The seal 24 slidably and sealably engages an inner surface 22 of container neck 15 as the closure 10 is threadably rotated onto the container 14.

A second type of rotary seal suitable for use with the closure-container package of FIG. 1 is called an "e"-seal bead 32 and is shown in FIG. 3. The rotary seal comprises a closure 10 having a having a top wall 12 and a skirt 18 depending from a peripheral edge thereof. A container 14 having a neck or upper portion 15 is threadably engaged to the closure 10. An external thread 26 extends radially from and helically around the neck 15 of container 14 as with the previously described embodiment. External thread 26 rotatably engages radially inward extending thread 16, which extends from an inner surface 19 of closure skirt 18. Above thread 16 is the inwardly directed "e"-seal bead 32 extending from an inner surface 19 of closure skirt 18. The "e"-seal bead 32 sealably engages an outer surface 23 of container neck 15 as the closure 10 is threadably rotated onto the container 14. The seal 32 is formed of moldable plastic preferably during either an injection or compression molding process when the closure 10 is formed.

The reverse taper plug seal 24 and the "e"-seal 32 can preferably be interchanged for use as rotary seal with the instant invention.

On-Direction Stop Mechanism

Figure 4:
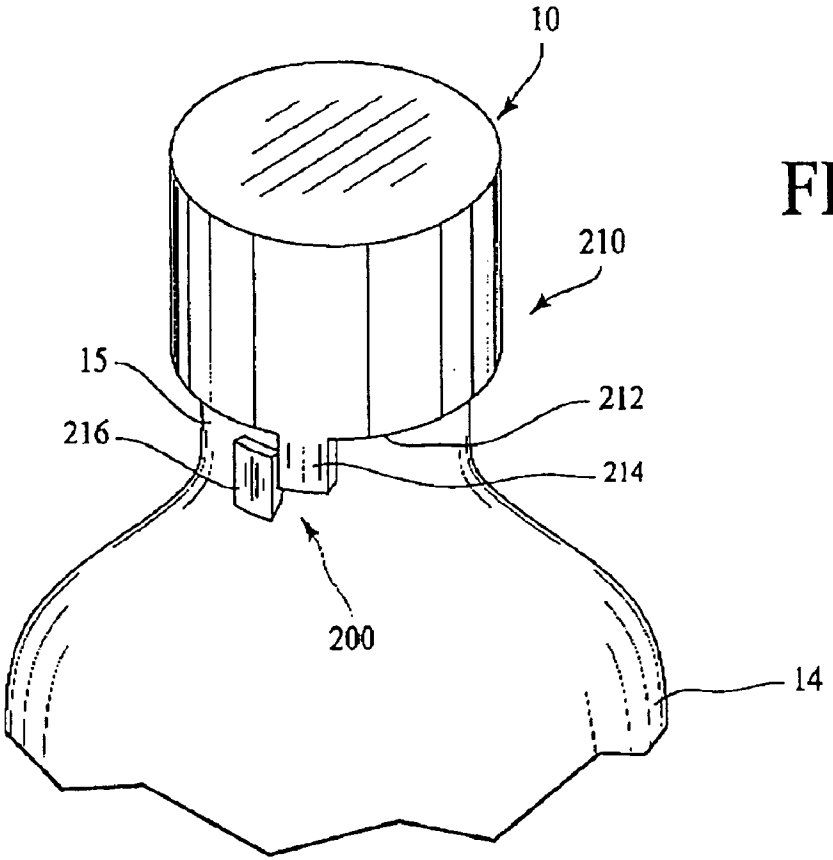
FIG. 4 shows an external on-direction stop mechanism of the closure-container package of the instant invention.

A closure-container on-direction stop embodiment is further provided in the instant invention for use with the closure-container package of FIG. 4. Generally, the on-direction stop provides a rib or lug on the closure 10 and container 14, which inhibit over-torquing of the closure 10 and the container 14. More specifically, the on-direction stop embodiment prevents at least two types of damage. First, seal damage is inhibited because the closure is not excessively threaded onto the container 14. Second, the threads 16 and 26 are not stripped by overtorquing the closure 10 onto the container 14. Thus, the seal and threads are undamaged such that spillage, leakage, and the like are prevented.

In a first embodiment an external on-direction stop mechanism 210 is utilized and is shown in FIG. 4. The external on-direction stop 210 is comprised of a closure 10 and a container 14, as described above and is preferably used with the rotary seal of FIG. 2 or 3. Depending from a lower peripheral edge 212 of closure 10 is a closure stop lug or rib 214. On container 14 is a container interference or stop lug 216 which engages closure stop lug 214 at a desired position when closure 10 is disposed on container 14 in a closed and sealed manner. Preferably, the container stop lug 216 is on the container neck 15 and is visibly exposed beneath the closure 10 when the closure 10 is on the container neck 15. Moreover, the container lug 216 may be positioned so that closure lug 214 contacts the container lug 216 without the threads 16,26 becoming stripped or without damaging the rotary seal. When, the closure 10 sealably engages the container 14. In addition, the engaging sides or faces of lugs 214 and 216 which make contact when the closure 10 is fully positioned on the container 14, are preferably flat and not beveled so that lug 214 cannot accidentally slide past or ramp over lug 216. The lugs 214,216 are preferably formed when the closure 10 and container 14 are molded, for example by a compression or an injection molding process. Moreover, the lugs 214,216 are preferably of a size which will not break when the lugs 214,216 engage each other as closure 10 is placed on the container 14 in a mechanically automated or manual process.

Figure 5:
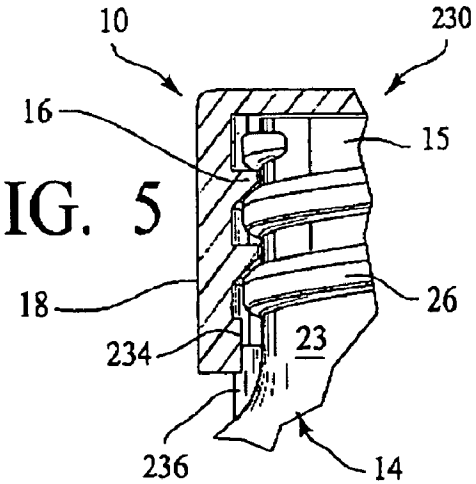
FIG. 5 shows a lower rib on-direction stop mechanism of the closure-container package of the instant invention.

In a second embodiment a lower rib or lug on-direction stop 230, a closure 10, and a container 14 are shown threadably engaging one another. As shown in FIG. 5, beneath a thread 26 is a container rib or lug 236 which interferingly engages a lower closure rib or lug 234 located on an inner surface of closure 10 and extending radially inward. Lug 236 may be a vertical rib or abutment which interferes with the continued rotation of closure lug 234. Container rib or lug 236 extends radially outward from an outer surface 23 of container neck 15. Lugs 234,236 are preferably formed from injection or compression molded plastic during molding of the closure 10 and container 14, respectively. Moreover, lugs 234,236 are sized such that they should not break when they engage each other as closure 10 is placed on the container 14 by either an automated or manual process. The closure lug 234 is preferably hidden from view from the outside of the closure-container package 50. Lugs 234,236 are preferably flat along mating surfaces such that lug 234 should not accidentally slide over or past 236. In the instant invention, mating surfaces or faces are those surfaces which make contact and inhibit further rotation of the closure 10. Lugs 234,236 are preferably positioned to engage when a predetermined torque is placed on the threads 16,26 and when the container 14 is sealed.

Figure 6:
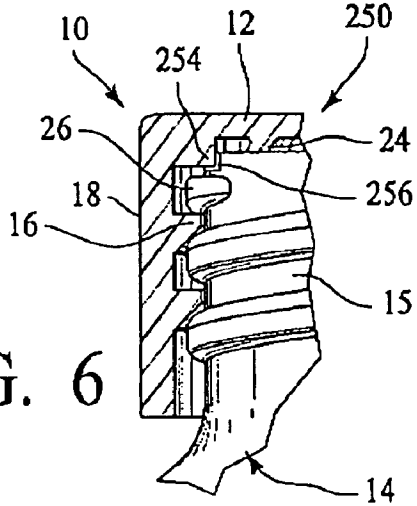
FIG. 6 shows an upper rib on-direction stop mechanism of the closure-container package of the instant invention.

As shown in FIG. 6, a third embodiment of the on-direction stop mechanism comprising upper lugs or ribs 256 is displayed. The on-direction stop mechanism 250 of this embodiment comprises a container 14 and a closure 10 threadably engaged thereon. An upper container lug 256 is located above the external thread 26 on container neck 15. An upper closure lug 254 or indention in the upper rim of the container neck is located above thread 16 and interferingly engages lug 256 on the container. As opposed to the second on-direction stop mechanism 230, this embodiment positions the lugs or ribs 254,256 at an upper portion of the container 14 and closure 10 and therefore may be invisible to the user. Lugs 254,256 are preferably flat along mating surfaces such that lug 254 should not accidentally slide over or past lug 256. Also lugs 254,256 are preferably positioned to engage when a predetermined torque is placed on the threads 16,26 and when the container 14 is sealed. Container lug 256 may be an outward extending lug or may be an inward indention, thereby creating a face 256 which engages a closure lug 254.

Figure 9:
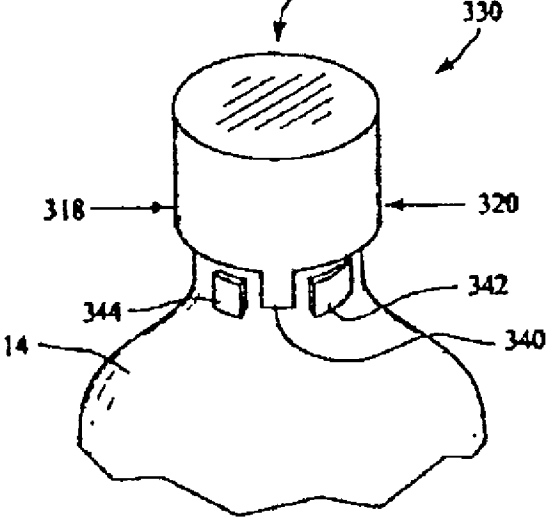
FIG. 9 shows an alternative embodiment of a child resistance feature of the closure-container package of the instant invention.

Referring now to FIG. 12, a perspective view of the closure-container package having the on-direction stop mechanism 230 (FIG. 6) is shown having the child resistance mechanism 330 of FIG. 9. As shown in FIGS. 6, 9, and 12 the closure 10 is fully seated on the container 14 in order that the closure end container tugs 254, 256 are fully engaged providing the on-direction stop mechanism. At the same time the closure CR lug 340 is rotated past the container CR lug 342 inhibiting back-off of the closure 10. Thus, the closure 10 cannot be rotated further on or off of the container neck 14 providing both on-direction stop and child resistance features.

Figure 7:
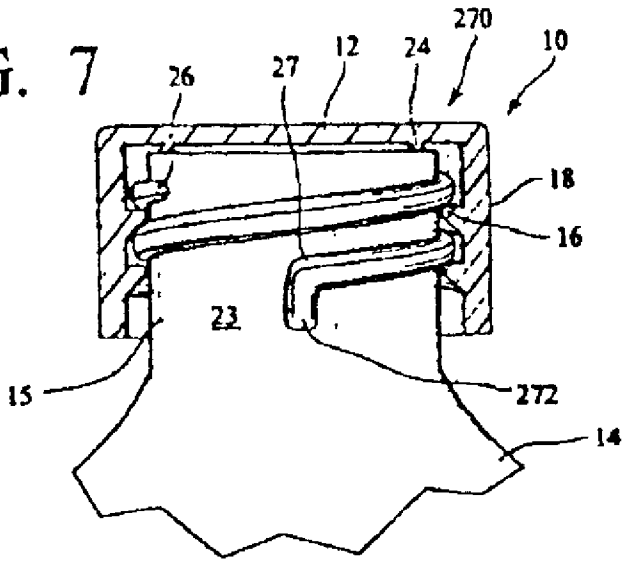
FIG. 7 shows a blunt end cap thread on-direction stop mechanism of the closure-container package of the instant invention.

A fourth embodiment of an on-direction stop mechanism is the blunt end closure thread 270. As shown in FIG. 7, this embodiment comprises a closure 10 and a container 14 threadably engaged by threads 16,26. At a lower end point 27 of thread 26 is a rib or protuberance 272 depending axially downward and extending radially outward from an outer surface 23 of container neck 15. The rib or protuberance 272 creates a stop for the closure 10 beyond which the closure 10 cannot be further threaded onto the container 14. Protuberance 272 is preferably designed to inhibit breakage during an automated mechanical installation of the closure 10. Protuberance 272 is also preferably shaped such that thread 16 should not accidentally slide over or past lug 236. Also rib or protuberance 272 and thread 16 are preferably positioned to engage when the container 14 is properly sealed and a predetermined torque is placed on the threads 16,26.

Child Resistance Feature

The instant invention may also include a child resistance feature. As shown in FIG. 8, a first embodiment of a child resistance feature 300 of the closure-container package of the instant invention includes a feature which inhibits individuals of a tender age from accessing and accidentally ingesting medication or other harmful chemicals. Moreover, the child resistant features 300 of the present embodiment require dissimilar movements to open the container 14 yet still allows those with, for instance, arthritis to easily access the contents of the container 14 when needed. In the first embodiment, the child resistant ("CR") feature 300 has at least one pair of CR closure lugs 312 and 314 depending from a lower peripheral edge of skirt 18. Extending radially outward from and axially upward along container neck 15 is CR container lug 316. A set of lugs may be located 180 degrees opposite 312,314,316 to provide additional child resistance and utilize the ovalized flex of the closure described below. As closure 10 is threadably rotated onto the container 14, lug 312 first encounters lug 316. With continued torque application to the closure 10, the lug 312 will pass over lug 316. To facilitate lug 312 moving past lug 316, lug 312 may have a tapered inner surface such that it may pass over lug 316 during application of closure 10 to container 14. As lug 312 passes lug 316, lug 312 becomes a child resistant member because the closure 10 cannot be unscrewed by merely rotating the closure 10 in the opposite direction as it was applied. Preferably surfaces of CR lugs 312,316 which abut one another when CR lug 316 is positioned between CR lug 312,314 are sized such that CR lug 312 cannot slide past CR lug 316 without a second dissimilar movement. In addition, lug 314 acts as an on-direction stop mechanism since further rotation of closure 10 onto container 14 is inhibited.

Located preferably about 90 degrees to lugs 312,314 are pressure points 318,320. Depressing the closure 10 at these pressure points 318,320 results in maximum ovalized flexure of the closure 10. As described above, closure 10 may be made of injection or compression molded plastic. The thickness of the closure skirt 18 is preferably such that it will deflect when a pressure is applied. By applying pressure to the lower portion of closure skirt 18 in two locations about 180 degrees apart the skirt 18 will flex radially outward along an axis 90 degrees from the application of pressure. This causes the closure 10 to distort to an ovalized shape while the pressure is applied which results in maximum displacement of CR lugs 312,314 such that CR lug 312 can be backed over CR lug 316 as the closure is unscrewed.

Alternatively, in a second embodiment of a CR feature 330 of the present invention, a single closure CR lug 340 may depend from a lower peripheral edge of the skirt 18 while a pair of container CR lugs 342,344 are extending from an outer surface 23 of the container 14. In this embodiment, shown in FIG. 9, the closure CR lug 340 must pass container CR lug 342 as the closure 10 is screwed onto the container 14. To ease the closure CR lug 340 past container CR lug 342, container CR lug 342 may be tapered from thin to thick along its outer surface in a clockwise direction. Once closure CR lug 340 is seated between container CR lugs 342, 344 container CR lug 344 acts as an on-stop device inhibiting the further torquing of closure 10 onto container 14. As well, container lug 342 becomes a child resistance mechanism because the closure CR lug 340 will not pass container CR lug 342. This embodiment employs pressure points 318,320 located 90 degrees from closure lug 340 as the above described embodiment. When depressed, the pressure points 318,320 permit maximum ovalized deflection of the closure and outward deflection of the CR lug 340. Thus a user may simply depress the pressure points and unscrew the closure 10 such that closure CR lug 340 passes container CR lug 342. Without depressing the pressure points 318,320 the container CR lug 342 is a child resistance feature and does not allow closure CR lug 342 to pass.

Tamper Indicating Band

Figure 11:
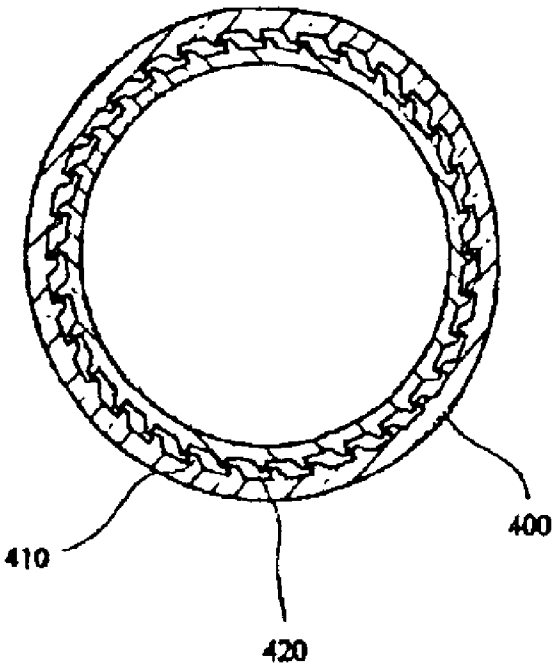
Figure 10:
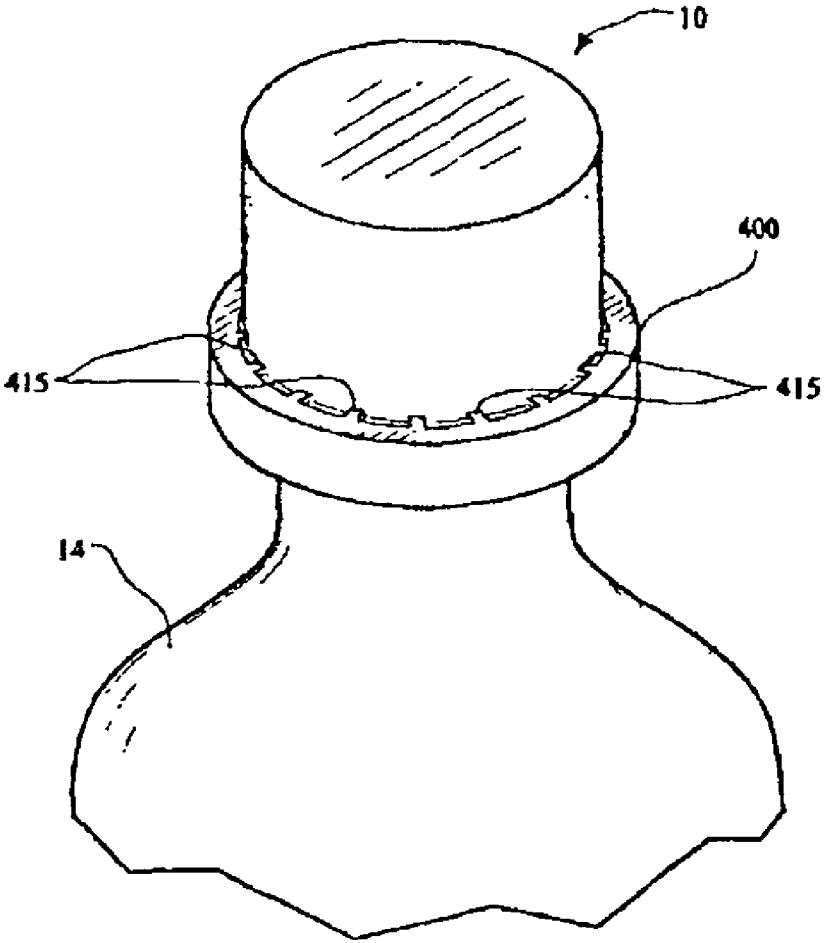
FIG. 10 shows a tamper indicating band of the closure-container package of the instant invention and, FIG. 11 shows a plurality of ratchets of the tamper indicating band engaging a plurality of ratchets of the container neck.

A tamper indicating band ("TI band") 400 may also be used in combination with the above described embodiments, depicted in FIGS. 10 and 11. The TI band 400 is preferably attached to the lower peripheral edge of closure 10 by a plurality of frangible webs or bridges 415. The TI band 400 may have a plurality of internal ratchets 410 located around an inner surface thereof. A plurality of external ratchets 420 are disposed about the outer surface 23 of container neck 15 for engaging with internal ratchets 410 when the closure container package 50 is initially opened. The internal ratchets 410 and external ratchets 420 may be substantially trapezoidal or triangular in shape and are each preferably angled such that when closure 10 is rotatably screwed onto container 14, ratchets 410 will easily pass over ratchets 420. However, when closure 10 is rotated in an opposite direction, the ratchets 410 operably engage a plurality of ratchets 420 extending from an outer surface of the container 14 and the frangible webs or bridges 415 break. This leaves the TI band 400 on the container 14 showing that the closure-container package has been previously opened.

Of course, many types of interference mechanisms may be utilized between a TI band and a container neck and these variations such as lugs, folding fingers, and other abutting or contacting surfaces are within the scope of teaching herein.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

I claim:

1. A threaded closure-container package, comprising:

a container having a shoulder and a neck extending upward from said shoulder and having an external thread;

a closure having a top wall and a skirt depending from a peripheral edge of said skirt top wall, said skirt having an internal thread mating said external thread;

said closure having a rotary seal operably connected thereto;

said closure and container each having at least one on-direction stop mechanisms;

said on-direction stop mechanism including a lug depending from said top wall and extending inwardly from said skirt;

said lug engaging a face disposed on an upper portion of said container neck;

said closure-container package having a child resistance mechanism.

2. The threaded closure-container package of claim 1, wherein said rotary seal is a reverse taper plug seal depending from an inner surface of said closure top wall, tapered radially outward.

3. The threaded closure-container package of claim 2, wherein said reverse taper plug sealingly engages an inner surface of said container neck.

4. The threaded closure-container package of claim 1, wherein said child resistance mechanism comprises at least one closure child resistance lug depending from a lower peripheral edge of said closure operably engaging at least one child resistance lug extending from said container.

5. A threaded closure-container package, comprising:

a container having a shoulder and a neck extending upward from said shoulder and having an external thread circumscribing said neck;

a closure having a top wall and a skirt depending from a peripheral edge of said skirt top wall, said skirt having an internal thread mating said external thread;

said closure having a rotary seal operably connected thereto;

said closure and said container each having at least one on-direction stop mechanism; and, said on-direction stop mechanism including a lug depending from said top wall and extending inwardly from said skirt;

said lug engaging a face on said container neck defined by an indention at an upper rim of said container neck; and, said closure-container package having a child resistance mechanism.

6. The threaded closure-container package of claim 5, wherein said rotary seal is a reverse taper plug seal depending from an inner surface of said closure top wall, tapered radially outward, and sealingly engaged to an inner surface of said container neck, and further comprising a tamper indicating band integral with said closure, said tamper indicating band connected to said closure by a plurality of frangible webs, and a plurality of external ratchets extending from said container neck operably engaging a plurality of internal ratchets extending from an inner surface of said tamper indicating band.

7. The threaded closure-container package of claim 5, wherein said rotary seal extends from an inner surface of said closure skirt and sealably engages said container neck, and, further comprising a tamper indicating band integral with said closure, said tamper indicating band connected to said closure by a plurality of frangible webs, and a plurality of external ratchets extending from said container neck engaging a plurality of internal ratchets extending from an inner surface of said tamper indicating band.

8. A threaded closure-container package, comprising:

a closure having a top wall and a skirt depending from a peripheral edge of said skirt;

a closure lug depending from the intersection of said top wall and said skirt;

a container neck being threadably attached to said closure;

said neck having a neck lug engaging said closure lug and defining an on-direction stop mechanism;

said closure having a reverse taper plug seal depending from said closure top wall and engaging an inner surface of said container neck; and;

a child resistant lug depending from said closure skirt engaging a child resistant lug on said container neck.

* * * * *